US011815266B2

(12) United States Patent
Shershnyov

(10) Patent No.: US 11,815,266 B2
(45) Date of Patent: Nov. 14, 2023

(54) COMBUSTOR NOZZLE, COMBUSTOR, AND GAS TURBINE INCLUDING SAME

(71) Applicant: DOOSAN ENERBILITY CO., LTD., Changwon-si (KR)

(72) Inventor: Borys Shershnyov, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/057,468

(22) Filed: Nov. 21, 2022

(65) Prior Publication Data

US 2023/0228423 A1 Jul. 20, 2023

(30) Foreign Application Priority Data

Jan. 18, 2022 (KR) ..... 10-2022-0007492

(51) Int. Cl.
*F23D 14/62* (2006.01)
*F23R 3/32* (2006.01)
(Continued)

(52) U.S. Cl.
CPC ..... *F23R 3/32* (2013.01); *F23D 14/62* (2013.01); *F23R 3/14* (2013.01); *F23R 3/286* (2013.01)

(58) Field of Classification Search
CPC .. F23D 14/62; F23D 14/64; F23R 3/14; F23R 3/38
See application file for complete search history.

(56) References Cited

U.S. PATENT DOCUMENTS 2,174,266 A * 9/1939 Jackson ..... F23R 3/14 60/39.38
4,100,733 A * 7/1978 Striebel ..... F23R 3/286 239/431

(Continued)

FOREIGN PATENT DOCUMENTS

CN 212537915 U 2/2021
EP 4207059 A1 7/2022

(Continued)

OTHER PUBLICATIONS

EP Search Report dated May 31, 2023.

*Primary Examiner* — Alain Chau
*Assistant Examiner* — Marc J Amar
(74) *Attorney, Agent, or Firm* — Harvest IP Law, LLP

(57) ABSTRACT

A combustor nozzle, a combustor, and a gas turbine including the same are proposed. The combustor nozzle includes a nozzle module. The nozzle module includes a fuel supply pipe supplying fuel from the front side to the rear side, a fuel plenum having an internal fuel flow path through which the fuel flows and communicating with the fuel supply pipe, an air inlet formed in front of the fuel plenum, a plurality of tubes disposed through a rear side of the fuel plenum, wherein a front end of each tube communicates with the air inlet, and a fuel port communicating with the fuel flow path is formed on a lateral side of each tube, and a swirler provided with a plurality of swirling guides disposed obliquely in axial and circumferential directions on an inner circumferential surface of each of the plurality of tubes to swirl fluid, with a central portion thereof opened when viewed from the axial direction of the tube.

20 Claims, 9 Drawing Sheets

(51) Int. Cl.
*F23R 3/14* (2006.01)
*F23R 3/28* (2006.01)

(56) References Cited

U.S. PATENT DOCUMENTS 5,778,676 A * 7/1998 Joshi ..... F23D 17/002 60/737
6,141,967 A * 11/2000 Angel ..... F23R 3/14 60/737
2006/0245296 A1 11/2006 Nishioka
2010/0269508 A1* 10/2010 Saito ..... F23R 3/14 60/748
2013/0045450 A1* 2/2013 Uhm ..... F23R 3/26 431/198
2013/0227953 A1* 9/2013 Uhm ..... F02C 3/30 60/738
2014/0338340 A1* 11/2014 Melton ..... F23D 14/62 60/738
2016/0038890 A1* 2/2016 Hobbs ..... F23D 14/62 366/178.2
2016/0186662 A1* 6/2016 Stewart ..... F23R 3/14 239/403
2016/0201908 A1* 7/2016 Drake ..... F02C 7/18 415/115
2017/0268780 A1* 9/2017 Purcell ..... F23R 3/286
2019/0107282 A1 4/2019 Seo
2019/0360697 A1* 11/2019 Tada ..... F23D 14/62
2021/0102703 A1 4/2021 Tada
2021/0302021 A1 9/2021 Biagioli

FOREIGN PATENT DOCUMENTS

JP H09196379 A 7/1997
JP 2011-075271 A 4/2011
JP 4700834 B2 6/2011
JP 2012-093077 A 5/2012
JP 6063251 B2 1/2017
JP 6203510 B2 9/2017
JP 2019207049 U 12/2019
KR 1020180128932 A 12/2018
KR 20190109955 A * 2/2019

* cited by examiner

COMBUSTOR NOZZLE, COMBUSTOR, AND GAS TURBINE INCLUDING SAME

CROSS REFERENCE TO RELATED APPLICATION

The present application claims priority to Korean Patent Application No. 10-2022-0007492, filed on Jan. 18, 2022, the entire contents of which are incorporated herein for all purposes by this reference.

BACKGROUND OF THE INVENTION

1. Field of the Invention

The present disclosure relates to a combustor nozzle, a combustor, and a gas turbine and, more particularly, to a combustor nozzle including a plurality of tubes with swirlers, a combustor, and a gas turbine including the same.

2. Description of the Background Art

A gas turbine is a combustion engine in which a mixture of air compressed by a compressor and fuel is combusted to produce a high temperature gas, which drives a turbine. The gas turbine is used to drive electric generators, aircraft, ships, trains, or the like.

The gas turbine generally includes a compressor, a combustor, and a turbine. The compressor serves to intake external air, compress the air, and transfer the compressed air to the combustor. The compressed air compressed by the compressor has a high temperature and a high pressure. The combustor serves to mix compressed air from the compressor and fuel and combust the mixture of compressed air and fuel to produce combustion gases, which are discharged to the gas turbine. The combustion gases drive turbine blades in the turbine to produce power. The power generated through the above processes is applied to a variety of fields such as generation of electricity, driving of mechanical units, etc.

Fuel is injected through nozzles disposed in respective combustors, wherein the fuel includes gaseous fuel and liquid fuel. In recent years, in order to suppress the emission of carbon dioxide, use of hydrogen fuel or a fuel containing hydrogen is recommended.

However, since hydrogen has a high combustion rate, when such fuels are burned with a gas turbine combustor, the flame formed in the gas turbine combustor approaches and heats the structure of the gas turbine combustor, thereby degrading the reliability of the gas turbine combustor.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a combustor nozzle capable of minimize nitrogen oxide generation and increasing flame stability by improving the mixing characteristics of fuel and air, a combustor, and a gas turbine including the same.

In an aspect of the present disclosure, there is provided a combustor nozzle including a nozzle module. The nozzle module includes a fuel supply pipe, a fuel plenum, an air inlet, a plurality of tubes, and a swirler. The fuel supply pipe supplies fuel from the front side to the rear side. The fuel plenum has an internal fuel flow path through which the fuel flows and communicating with the fuel supply pipe. The air inlet is formed in front of the fuel plenum. The tube is disposed through a rear side of the fuel plenum, wherein a front end thereof communicates with the air inlet, and a fuel port communicating with the fuel flow path is formed on a lateral side thereof. The swirler is provided with a plurality of swirling guides disposed obliquely in axial and circumferential directions on an inner circumferential surface of each of the plurality of tubes to swirl a fluid, with a central portion thereof opened when viewed from the axial direction of the tube.

In an embodiment, the swirler may have the central portion opened in a circular shape when viewed from the axial direction of the tube.

In an embodiment, the plurality of swirling guide may be disposed in a continuous annular shape when viewed from the axial direction of the tube.

In an embodiment, the plurality of swirling guide may include a straight part extending along the axial direction of the tube and a swirling part extending in the axial and circumferential directions of the tube from a rear end of the straight part.

In an embodiment, the swirling part may be formed to be inclined in a curved form on the tube.

In an embodiment, the length of the swirling part in the axial direction of the tube may be formed longer than that of the straight part.

In an embodiment, a front end of the straight part may be provided with an inclined portion inclined toward the rear side as the inclined portion extends from the outside toward the inside of the tube.

In an embodiment, the fuel port may include a first fuel port passing through the tube and the plurality of swirling guides and disposed on the plurality of swirling guides.

In an embodiment, the fuel port may include a first fuel port passing through the tube and the plurality of swirling guides and disposed on the straight part.

In an embodiment, the fuel port may include a second fuel port passing through the tube and disposed between the plurality of swirling guides.

In an embodiment, the fuel port may include a second fuel port passing through the tube and disposed between the straight parts.

In an embodiment, the fuel port may include a second fuel port passing through the tube and disposed between the plurality of swirling guides.

In an embodiment, the swirler may be disposed at the front end of the tube.

In an embodiment, the fuel port may include a third fuel port passing through the tube and disposed at a front side of the swirler.

In an embodiment, the fuel port may include a fourth fuel port passing through the tube and disposed at a rear side of the swirler.

In another aspect of the present disclosure, there is provided a combustor including a combustor nozzle, and a duct assembly. The combustor nozzle includes a nozzle module. The duct assembly is coupled to one side of the combustor nozzle. In the duct assembly, fuel and air are combusted, and the combustion gases are delivered to a turbine. The nozzle module includes a fuel supply pipe, a fuel plenum, an air inlet, a plurality of tubes, and a swirler. The fuel supply pipe supplies fuel from the front side to the rear side. The fuel plenum has an internal fuel flow path through which the fuel flows, the fuel flow path communicating with the fuel supply pipe. The air inlet is formed in front of the fuel plenum. The tube is disposed through a rear side of the fuel plenum, wherein a front end thereof communicates with the air inlet, and a fuel port communicating with the fuel flow path is formed on a lateral side thereof. The swirler is provided with a plurality of swirling guides disposed obliquely in axial and circumferential directions on an inner circumferential surface of each of the plurality of tubes to swirl a fluid, with a central portion thereof opened when viewed from the axial direction of the tube.

In an embodiment, the swirler may have the central portion opened in a circular shape when viewed from the axial direction of the tube.

In an embodiment, the plurality of swirling guides may include a straight part extending along the axial direction of the tube and a swirling part extending in the axial and circumferential directions of the tube from a rear end of the straight part.

In an embodiment, the fuel port may include a first fuel port passing through the tube and the plurality of swirling guides and disposed on the plurality of swirling guides.

In a further aspect of the present disclosure, there is provided a gas turbine including a compressor, a combustor, and a turbine. The compressor compresses air introduced from the outside. The combustor mixes the air compressed in the compressor and fuel and combusts an air-fuel mixture. The turbine includes a plurality of turbine blades to be rotated by combustion gases combusted in the combustor. The combustor includes a combustor nozzle and a duct assembly. The nozzle includes a nozzle module. The duct assembly is coupled to one side of the combustor nozzle. In the duct assembly, the fuel and the air are combusted, and the combustion gases are delivered to a turbine. The nozzle module includes a fuel supply pipe, a fuel plenum, an air inlet, a plurality of tubes, and a swirler. The fuel supply pipe supplies fuel from the front side to the rear side. The fuel plenum has an internal fuel flow path through which the fuel flows, the fuel flow path communicating with the fuel supply pipe. The air inlet is formed in front of the fuel plenum. The tube is disposed through a rear side of the fuel plenum, wherein a front end thereof communicates with the air inlet, and a fuel port communicating with the fuel flow path is formed on a lateral side thereof. The swirler is provided with a plurality of swirling guides disposed obliquely in axial and circumferential directions on an inner circumferential surface of the plurality of tubes to swirl a fluid, with a central portion thereof opened when viewed from the axial direction of the tube.

According to the combustor nozzle, the combustor, and the gas turbine including the same, the plurality of tubes with swirlers are provided so that the mixing characteristics of fuel and air are improved and the generation of nitrogen oxide is minimized to increase flame stability.

DETAILED DESCRIPTION OF THE INVENTION

Figure 1:
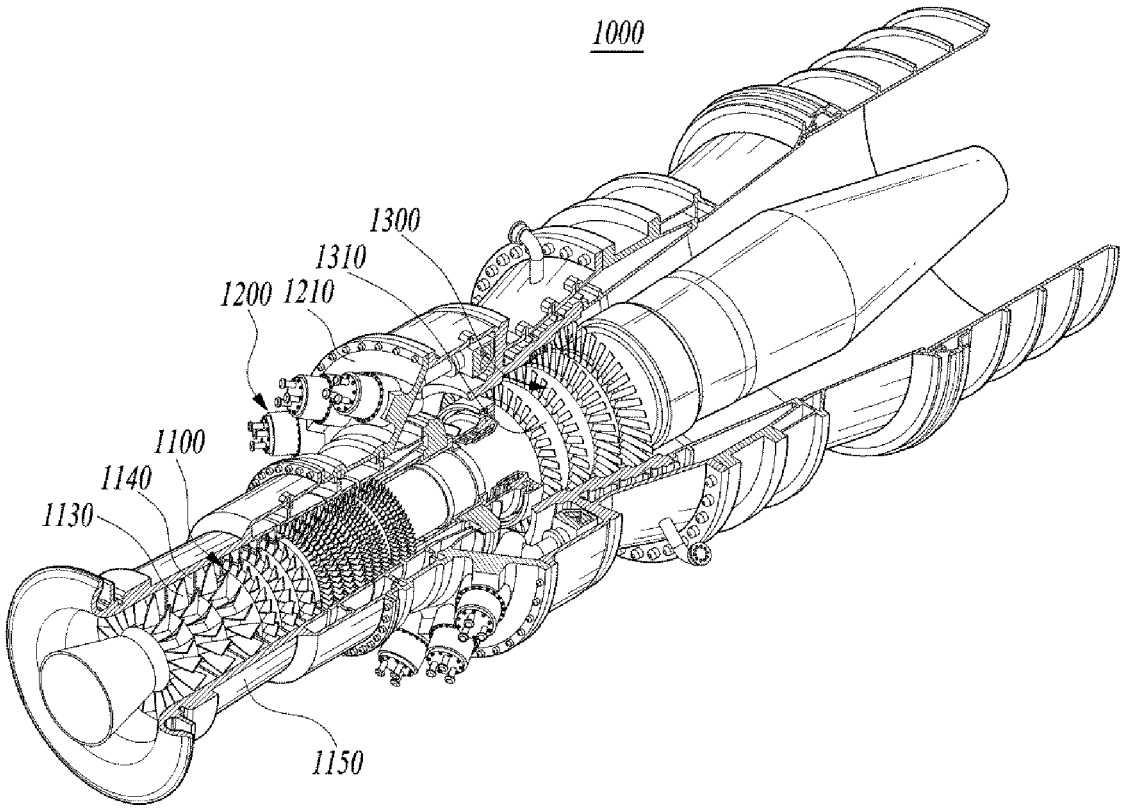
FIG. 1 is a view illustrating the interior of a gas turbine according to a first embodiment of the present disclosure.

Hereinafter, exemplary embodiments of the present disclosure will be described in detail with reference to the accompanying drawings. However, it should be noted that the present disclosure is not limited thereto, but may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the terms "comprising" or "including" specifies the presence of stated features, numbers, steps, operations, elements, parts, or combinations thereof, but does not preclude the presence or addition of one or more other features, numbers, steps, operations, elements, parts, or combinations thereof. Hereinafter, preferred embodiments of the present disclosure will be described in detail with reference to the accompanying drawings.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

Hereinafter, a combustor nozzle, a combustor, and a gas turbine including the same according to the present disclosure will be described.

Figure 2:
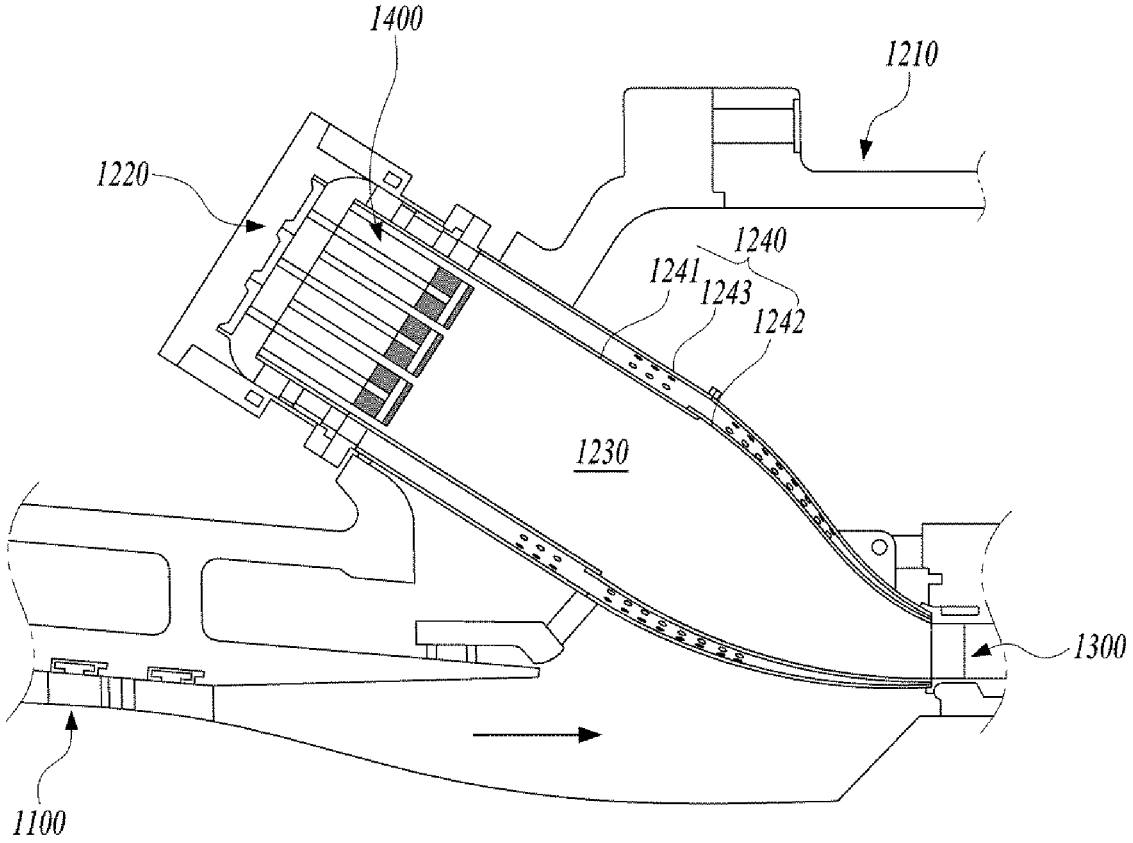
FIG. 2 is a view illustrating a combustor of FIG. 1.

FIG. 1 is a view illustrating the interior of a gas turbine according to an embodiment of the present disclosure, and FIG. 2 is a view illustrating a combustor of FIG. 1.

The gas turbine will now be described with reference to FIGS. 1 and 2.

An ideal thermodynamic cycle of a gas turbine 1000 according to the present embodiment follows a Brayton cycle. The Brayton cycle consists of four thermodynamic processes: isentropic compression (adiabatic compression), isobaric combustion, isentropic expansion (adiabatic expansion) and isobaric heat ejection. That is, in the Brayton cycle, atmospheric air is sucked and compressed into high pressure air, mixed gas of fuel and compressed air is combusted at constant pressure to discharge heat energy, heat energy of hot expanded combustion gas is converted into kinetic energy, and exhaust gases containing remaining heat energy is discharged to the outside. That is, gases undergo four thermodynamic processes: compression, heating, expansion, and heat ejection.

As illustrated in FIG. 1, the gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIG. 1, the compressor 1100 of the gas turbine 1000 may suck and compress air. The compressor 1100 may serve both to supply the compressed air by compressor blades 1130 to a combustor 1200 and to supply the cooling air to a high temperature region of the gas turbine 1000. Here, since the sucked air undergoes an adiabatic compression process in the compressor 1100, the air passing through the compressor 1100 has increased pressure and temperature.

The compressor 1100 is usually designed as a centrifugal compressor or an axial compressor, and the centrifugal compressor is applied to a small-scale gas turbine, whereas a multi-stage axial compressor is applied to a large-scale gas turbine 1000 illustrated in FIG. 1 since the large-scale gas turbine 1000 is required to compress a large amount of air. In this case, in the multi-stage axial compressor, the compressor blades 1130 of the compressor 1100 rotate according to the rotation of the rotor disks to compress the introduced air and move the compressed air to the compressor vanes 1140 on the rear stage. As the air passes through the compressor blades 1130 formed in multiple stages, the air is compressed to a higher pressure.

The compressor vanes 1140 are mounted inside the housing 1150 in stages. The compressor vanes 1140 guide the compressed air moved from the front side compressor blades 1130 toward the rear-side compressor blades 1130. In one embodiment, at least some of the compressor vanes 1140 may be mounted so as to be rotatable within a predetermined range for adjustment of an air inflow, or the like.

The compressor 1100 may be driven using a portion of the power output from the turbine 1300. To this end, as illustrated in FIG. 1, the rotary shaft of the compressor 1100 and the rotary shaft of the turbine 1300 may be directly connected. In the case of the large-scale gas turbine 1000, almost half of the output produced by the turbine 1300 may be consumed to drive the compressor 1100. Accordingly, improving the efficiency of the compressor 1100 has a direct effect on improving the overall efficiency of the gas turbine 1000.

The turbine 1300 includes a rotor disk 1310 and a plurality of turbine blades and turbine vanes radially disposed on the rotor disk 1310. The rotor disk 1310 has a substantially disk shape on which a plurality of grooves is formed. The grooves are formed to have curved surfaces, and turbine blades and turbine vanes are inserted into the grooves. The turbine vanes are fixed against rotation and guide a flow of combustion gases through the turbine blades. The turbine blades are rotated by combustion gases to generate rotational force.

On the other hand, the combustor 1200 serves to mix the compressed air supplied from an outlet of the compressor 1100 with fuel and combust the mixture at constant pressure to produce hot combustion gases. FIG. 2 illustrates an example of the combustor 1200 provided in the gas turbine 1000. The combustor 1200 may include a combustor casing 1210, nozzles 1220, and a duct assembly 1240.

The combustor casing 1210 may have a substantially circular cylindrical shape in which the nozzles 1220 are surrounded. The nozzle 1220 is disposed downstream of the compressor 1100 and may be disposed along the annular combustor casing 1210. Each nozzle 1220 is provided with at least one nozzle module 1400, through which fuel and air are mixed in an appropriate ratio and injected to achieve a suitable state for combustion.

The gas turbine 1000 may use a gas fuel, in particular, a fuel containing hydrogen. The fuel may include a hydrogen fuel alone or a fuel containing hydrogen and natural gas.

The duct assembly is provided to connect the nozzles 1220 and the turbine 1300 so that the hot combustion gas flows therethrough to heat the duct assembly, whereas the compressed air flows towards the nozzles 1220 along an outer surface of the duct assembly 1240, thereby properly cooling the heated duct assembly 1240.

The duct assembly 1240 may include a liner 1241 and a transition piece 1242, and a flow sleeve 1243. The duct assembly 1240 has a double structure in which the flow sleeve 1243 surrounds the outside of the liner 1241 and the transition piece 1242, so that compressed air penetrates into an annular space inside the flow sleeve 1243 to cool the liner 1241 and the transition piece 1242.

The liner 1241 is a tube member connected to the nozzles 1220 of the combustor 1200, wherein an internal space of the liner 1241 defines the combustion chamber 1230. A longitudinal one side of the liner 1241 is coupled to the nozzle 1220, and the other side of the liner 1241 is coupled to the transition piece 1242.

The transition piece 1242 is connected an inlet of the turbine 1300 to guide the hot combustion gas toward the turbine 1300. A longitudinal one side of the transition piece 1242 is coupled to the liner 1241, and the other side of the transition piece 1242 is coupled to the turbine 1300. The flow sleeve 1243 serves to protect the liner 1241 and the transition piece 1242 while avoiding direct exhaust of hot air to the outside.

Figure 3:
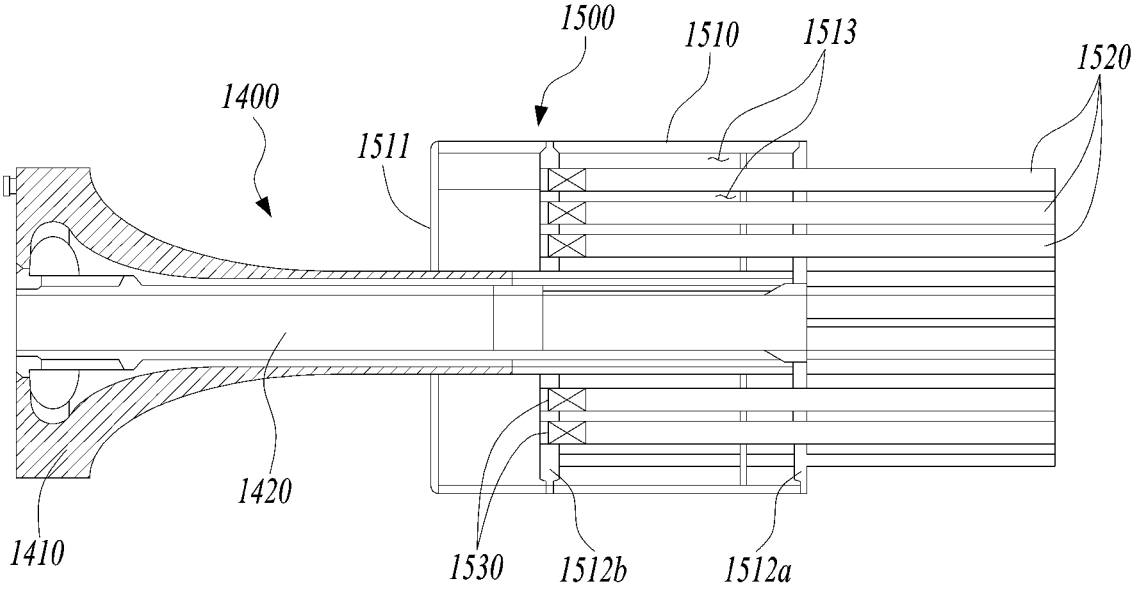
FIG. 3 is a longitudinal-sectional view illustrating a state in which a nozzle module is coupled to a tube assembly in a combustor nozzle according to a first embodiment of the present disclosure.
Figure 4:
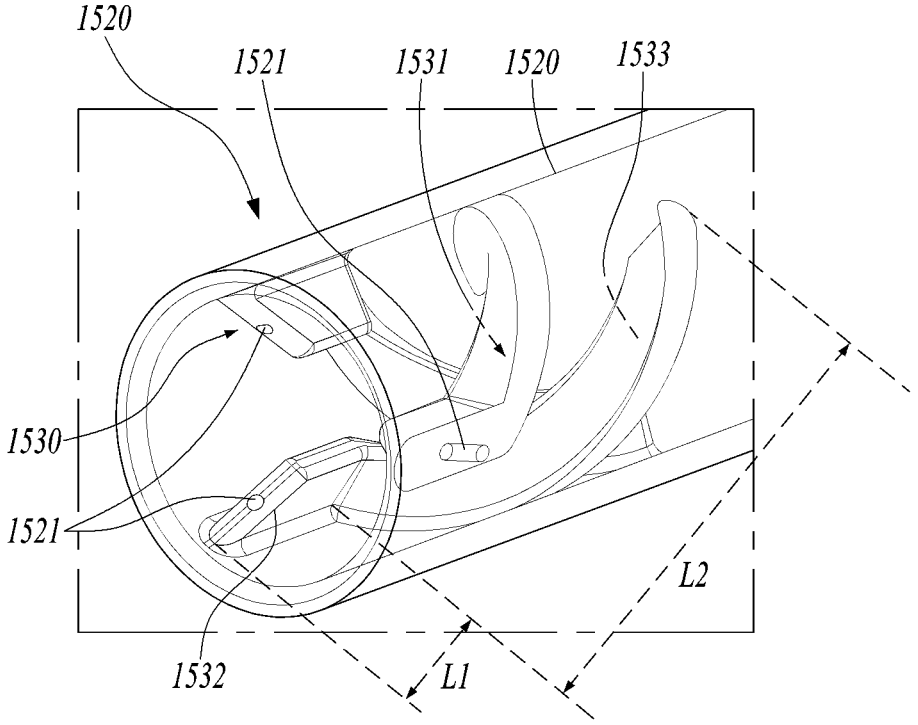
FIG. 4 is a perspective view separately illustrating a tube and a swirler in FIG. 3 in an enlarged fashion.
Figure 5:
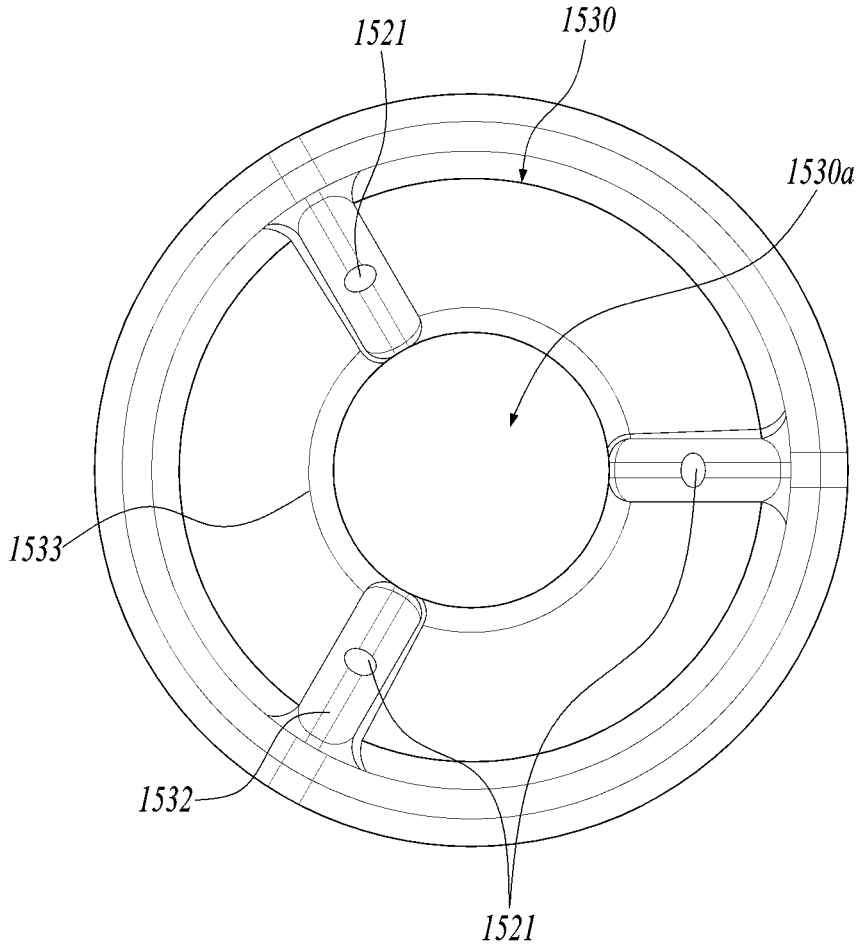
FIG. 5 is a front view separately illustrating a tube and a swirler in FIG. 3 in an enlarged fashion.
Figure 6:
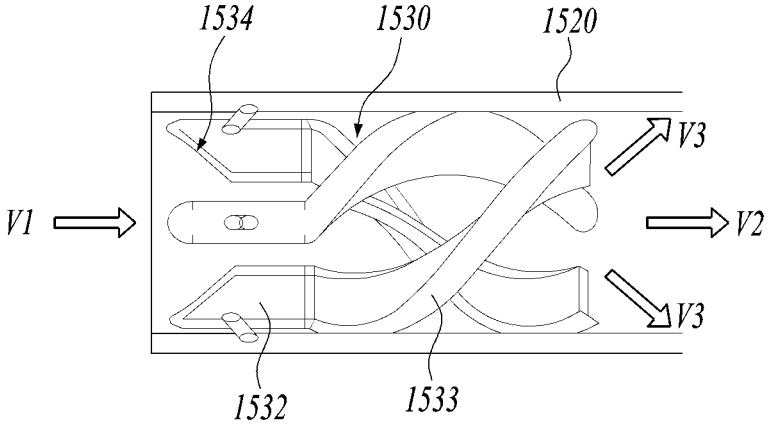
FIG. 6 schematically illustrates distribution of a flow velocity formed around the swirler according to the first embodiment of the present disclosure.

FIG. 3 is a longitudinal cross-sectional view illustrating a state in which a nozzle module is coupled to a tube assembly in a combustor nozzle according to a first embodiment of the present disclosure, FIG. 4 is a perspective view separately illustrating a tube and a swirler in FIG. 3 in an enlarged fashion, FIG. 5 is a front view separately illustrating a tube and a swirler in FIG. 3 in an enlarged fashion, and FIG. 6 schematically illustrates distribution of a flow velocity formed around the swirler according to the first embodiment of the present disclosure.

Hereinafter, the combustor nozzle 1220 according to the first embodiment of the present disclosure will be described in detail with reference to FIGS. 3 to 6. The combustor nozzle 1220 includes at least one nozzle module 1400. The nozzle module 1400 includes a fuel supply pipe 1420 and a tube assembly 1500, which includes swirlers 1530.

The fuel supply pipe 1420 is a tubular member for supplying fuel from the front side to the rear side. An internal fuel flow path through which fuel flows is formed in the fuel supply pipe 1420. According to an embodiment, a flange 1410 may be disposed at a front end of the fuel supply pipe 1420, and fuel may flow into the fuel supply pipe 1420 through the flange 1410.

The tube assembly 1500 includes a fuel plenum 1510, a tube 1520, and a swirler 1530. The fuel plenum 1510 may have a substantially cylindrical shape and may be disposed to surround at least a portion of the rear end side of the fuel supply pipe 1420. An open air inlet 1511 is formed at a front end of the fuel plenum 1510 to allow air to be introduced therethrough.

According to an embodiment, a first support plate 1512*a* may be disposed at a rear end of the fuel plenum 1510, and a second support plate 1512*b* may also be disposed between the rear end of the fuel plenum 1510 and the air inlet 1511. The fuel supply pipe 1420 may be disposed so as to pass through the second support plate 1512*b* disposed between the rear end of the fuel plenum 1510 and the air inlet 1511, and be inserted up to the first support plate 1512*a* disposed at the rear end of the fuel plenum. Meanwhile, a space is formed between the first and second support plates 1512*b* disposed in the fuel plenum 1510, and the space communicates with the fuel supply pipe 1420. Accordingly, a fuel flow path 1513 through which fuel flows is formed in the space.

The plurality of tubes 1520 are disposed in the fuel plenum 1510 in the form of a bundle. The tube 1520 may be inserted up to the second support plate 1512*b* through the first support plate 1512*a* disposed on the rear end side of the fuel plenum 1510. Accordingly, each tube 1520 is inserted into the fuel flow path 1513. In addition, the tube 1520 may be supported by the first and second support plates 1512*b*. Meanwhile, a gap between the tube 1520 and the first/second support plate 1512*a*/1512*b* may be sealed to prevent fuel leakage to the outside from the fuel flow path.

Air may be introduced through the front end of the tubes 1520. The air introduced through the air inlet 1511 of the fuel plenum 1510 may flow in the fuel plenum 1510 and flow into respective front ends of the tubes 1520. The introduced air may pass through the tubes 1520 and be discharged through the rear ends of the tubes 1520. The rear ends of the tubes 1520 communicate with a combustion chamber 1230. Accordingly, air and fuel are mixed in the tubes 1520, and the mixed fluid of the air and the fuel is discharged through the rear ends of the tubes 1520 and injected into the combustion chamber 1230.

A fuel port is formed in the tube 1520. According to an embodiment, the fuel port may be formed on a lateral side of the tube 1520. The fuel port communicates with the fuel flow path 1513 of the fuel plenum 1510, as well as with an inner flow path of the tube 1520. Accordingly, the fuel flowing in the fuel flow path 1513 may be introduced into the tube 1520 through the fuel port. Since air and fuel flow together in the tube 1520, the air and the fuel are mixed with each other in the tube 1520.

A swirler 1530 is disposed inside the tube 1520. The swirler 1530 is configured to swirl a flow of fluid flowing in the tube 1520, that is, a flow of air and fuel. According to an embodiment, the swirler 1530 includes a swirling guide 1531 for swirling the fluid. The plurality of swirling guides 1531 may be provided. According to an embodiment, the swirling guide 1531 may be disposed on an inner circumferential surface of the tube 1520.

According to an embodiment, when the tube 1520 and the swirler 1530 are viewed in an axial direction of the tube 1520, a central portion 1530*a* of the swirler 1530 is open. Accordingly, when a fluid passes through the swirler 1530 in the tube 1520, a flow of the fluid may be divided into a linear flow flowing in a straight direction and a swirling flow flowing in a swirling direction. For example, the fluid passing through the central opening of the swirler 1530 is the linear flow and flows in a straight direction in a direction toward the rear end of the tubes 1520 without being swirled. And, the fluid not passing through the open central portion 1530*a* of the swirler 1530 is a swirling flow and swirls during passing through the swirling guide 1531 of the swirler 1530. According to an embodiment, even after the fluid passes through the swirler 1530, a linear flow may be formed in the center, and a swirling flow may be formed around and surrounding the linear flow.

According to an embodiment, flow resistance is reduced in the linear flow to minimize pressure loss and allow for a straight forward flow of fluid at a high speed. In addition, since the linear flow pushes the fluid at a high speed, it is possible to minimize the flame attachment or the flame backfire. Meanwhile, the swirling flow may swirl fluid to improve the air-fuel mixture. According to an embodiment, the linear flow and the swirling flow are not completely separated from each other, but may be formed such that at least a part of the swirling flow is drawn to the linear flow. Accordingly, as the linear flow and the swirling flow are formed together, it is possible to advantageously improve the mixing characteristics of air and fuel while minimizing pressure loss of the air-fuel mixture.

According to an embodiment, when the tube 1520 and the swirler 1530 are viewed in the axial direction of the tube 1520, the central portion 1530*a* of the swirler 1530 may be opened in a circular shape. In this case, the linear flow may be formed in a circular cross section when viewed in the axial direction of the tube 1520.

In addition, according to an embodiment, when the tube 1520 and the swirler 1530 are viewed in the axial direction of the tube 1520, the swirling guides 1531 may be arranged in an annular shape. At this time, the swirling guides 1531 may be arranged in a continuous annular shape. When viewed in the axial direction, the swirling guides 1531 adjacent to each other may be disposed to overlap each other. In this case, a portion except the central portion 1530*a* of the swirler 1530 is occupied by the swirling guides 1531, and accordingly, a swirling flow may entirely surround the outer circumference of a linear flow.

According to an embodiment, the swirling guide 1531 may include a straight part 1532 and a swirling part 1533. The straight part 1532 extends long and straight along the axial direction of the tube 1520. The straight part 1532 may be formed to protrude from the inner circumferential surface of the tube 1520 toward the inside of the tube 1520 and extend in the longitudinal direction, which is the axial direction of the tube 1520. The straight part 1532 may be disposed on the front side of the swirling guide 1531. The straight part 1532 is configured to guide fluid flowing into the swirler 1530 in the axial direction of the tube 1520. The straight part 1532 minimizes pressure loss at the swirling guide 1531 because the straight part guides fluid in the axial direction before the fluid passes through the swirling part 1533.

According to an embodiment, the swirling part 1533 may be disposed on the rear side of the straight part 1532. The swirling part 1533 may be formed to extend from the rear end of the straight part 1532. The swirling part 1533 may protrude from the inner circumferential surface of the tube 1520 toward the inside of the tube 1520. The swirling part 1533 extends in the axial and circumferential directions of the tube 1520. That is, the swirling part 1533 may be formed to be inclined in a direction between the axial direction and the circumferential direction. The swirling part 1533 is configured to swirl fluid that has passed through the straight part 1532.

According to an embodiment, the swirling part 1533 may be formed to be inclined in the form of a curve. According to an embodiment, the swirling part 1533 may be formed to be inclined in the axial direction and the circumferential direction of the tube 1520 such that the swirling part is convex or concave toward the front or rear end of the tube 1520. In this case, it is possible to effectively swirl fluid passing through the swirling part 1533 while reducing the flow resistance of the fluid. In addition, a portion where the swirling part 1533 and the straight part 1532 meet may be formed to be gently, gradually curving and continuously connected to each other. In this case, it is possible to reduce the flow resistance of fluid flowing into the swirling part 1533.

According to an embodiment, based on the axial direction of the tube 1520, the length L2 of the swirling part 1533 may be formed to be longer than the length L1 of the straight part 1532. The main purpose of the swirling guide 1531 is to swirl fluid. Therefore, if the length L1 of the straight part 1532 is formed shorter than the length L2 of the swirling part 1533, there is an advantage that the entire size of the swirler 1530 can be manufactured compactly while effectively swirling the fluid.

According to an embodiment, the inclined portion 1534 may be formed on the straight part 1532 of the swirling guide 1531. The inclined portion 1534 may be formed at the front end of the straight part 1532. The inclined portion 1534 may be inclined backward toward the inside of the tube 1520. Since the straight part 1532 is formed to protrude from the inner circumferential surface of the tube 1520 toward the inside of the tube 1520, when fluid flows into the straight part 1532, the flow resistance at the front end of the straight part 1532 becomes large. At this time, if the inclined portion 1534 is disposed on the straight part 1532, it is possible to reduce the flow resistance of the fluid flowing into the straight part 1532.

According to an embodiment, the fuel port may include a first fuel port 1521. The first fuel port 1521 is a fuel port disposed on the swirling guide 1531. The first fuel port 1521 may be formed at an inner end of the tube 1520 of the swirling guide 1531, or the first fuel port 1521 may be formed on the lateral side of the swirling guide 1531. The first fuel port 1521 is formed through the tube 1520 and the swirling guide 1531. Accordingly, the fuel in the fuel flow path 1513 of the fuel plenum 1510 may pass through the first fuel port 1521, and injected from the swirling guide 1531. As the first fuel port 1521 is disposed on the swirling guide 1531, fuel may be directly injected into the fluid flowing in a linear form or a swirling form. The first fuel port 1521 may be formed in the straight part 1532 or the swirling part 1533 of the swirling guide 1531. According to an embodiment, if the first fuel port 1521 is disposed at an inner end of the swirling guide 1531, the fuel is directly injected into the fluid flowing in a linear from. If the first fuel port 1521 is disposed on the lateral side of the swirling guide 1531, the fuel is injected into the fluid flowing in a swirling form.

According to an embodiment, the first fuel port 1521 may be formed in the straight part 1532, the fuel may be directly injected as soon as the fluid flows into the swirler 1530. According to an embodiment, in this case, the first fuel port 1521 may be disposed in the inclined portion 1534 of the straight part 1532. In this case, a flow of the fuel injected from the first fuel port 1521 may be divided into a linear flow and a swirling flow. In other words, in this case, a part of the flow of the fuel injected from the first fuel port 1521 may join in the linear flow while another part of the flow of the fuel injected from the first fuel port 1521 may join in the swirling flow.

According to an embodiment, the swirler 1530 may be disposed at the front end of the tube 1520. For the convenience, the front end of the tube 1520 is used to refer to not only the front end terminal of the tube 1520 itself, but also refers to the front end of the tube 1520 and its surroundings. According to an embodiment, the swirling guide 1531 of the swirler 1530 may be in contact with the front end of the tube 1520, or may be disposed slightly spaced apart therefrom while still being disposed at the front end of the tube 1520. When the swirler 1530 is disposed at the front end of the tube 1520, since the fluid starts swirling from the front end of the tube 1520, there is an advantage that the overall length of the tube 1520 can be reduced.

FIG. 6 schematically illustrates a flow rate of fluid around the swirler 1530. The flow rate before passing through the swirler 1530 is a first flow rate V1, the flow rate of a linear flow after passing through the swirler 1530 is a second flow rate V2, and the flow rate of a swirling flow after passing the swirler 1530 is a third flow rate V3.

Among the first to third flow rates V1 to V3, the second flow rate V2 is a fastest flow rate. As the fluid flows through the central opening portion of the swirler 1530, a flow cross-sectional area decreases in general, and, the flow is converted into a linear flow and accordingly, the flow rate is increased from the first flow rate V1 to the second flow rate V2. In addition, the third flow rate V3 of the swirling flow is larger than the first flow rate V1, but smaller than the second flow rate V2. Since the fluid swirls due to the swirling guide 1531 and so the flow rate decreases, due to the interaction with the linear flow, which is the second flow rate V2, a flow rate of the swirling flow is greater than the first flow rate V1.

Figure 7:
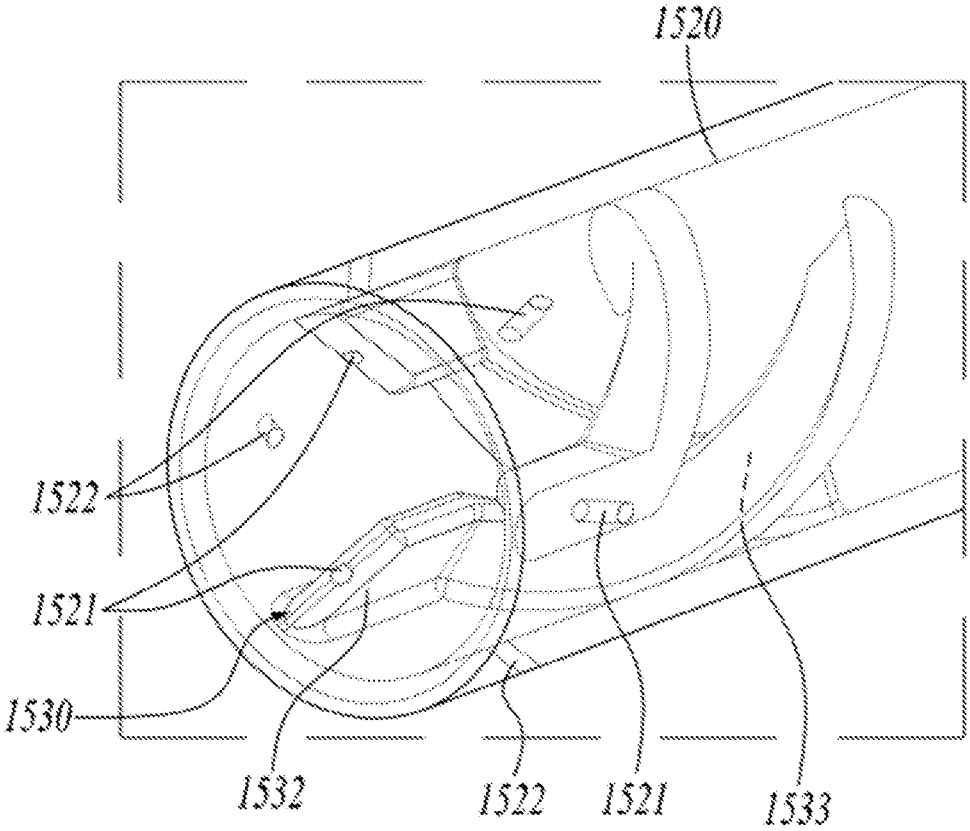
FIG. 7 is a perspective view separately illustrating a tube and a swirler of a nozzle according to a second embodiment of the present disclosure in an enlarged fashion.

FIG. 7 is a perspective view separately illustrating a tube and a swirler of a nozzle according to a second embodiment of the present disclosure in an enlarged fashion.

Hereinafter, a combustor nozzle 1220 according to a second embodiment of the present disclosure will be described in detail with reference to FIG. 7. Since the combustor nozzle 1220 according to the second embodiment of the present disclosure is the same as the combustor nozzle 1220 according to the first embodiment of the present disclosure, except for a second fuel port 1522, a redundant description thereof will be omitted.

In the combustor nozzle 1220 according to the second embodiment, the fuel port includes a second fuel port 1522. The second fuel port 1522 may be formed through the tube 1520 and is disposed between the plurality of swirling guides 1531. In other words, the second fuel port 1522 may be formed on an inner wall of the tube 1520 between the plurality of swirling guides 1531. The second fuel port 1522 communicates with the fuel flow path 1513 of the fuel plenum 1510 and communicates with the inside of the tube 1520. The second fuel port 1522 may inject the fuel between the swirling guides 1531. Accordingly, the fuel injected from the second fuel port 1522 is directly injected into the portion where the swirling flow is formed at the swirler 1530, so that the mixing characteristics of air and fuel can be improved.

According to an embodiment, the second fuel port 1522 may be disposed between the plurality of straight parts 1532, and/or between the plurality of swirling parts 1533. The plurality of second fuel ports 1522 may be disposed between the plurality of straight parts 1532 and/or between the plurality of swirling parts 1533.

Figure 8:
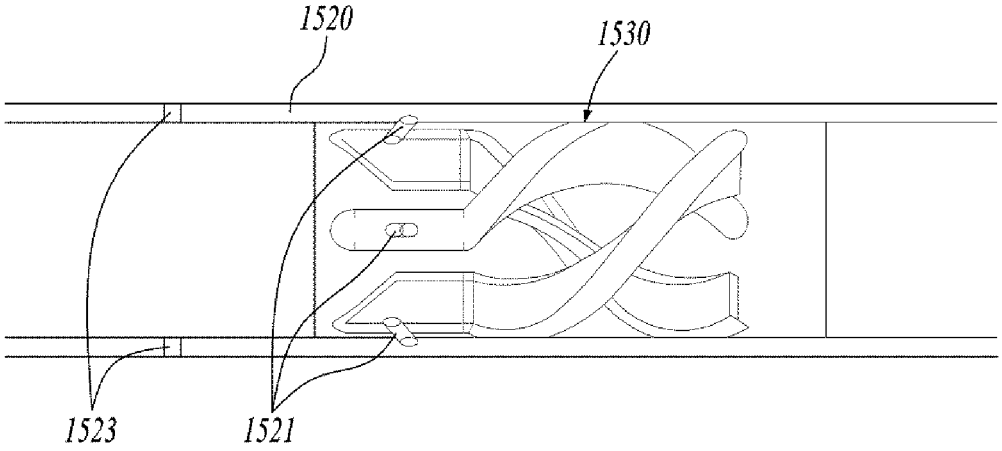
FIG. 8 is a longitudinal-sectional view separately illustrating a tube and a swirler of a nozzle according to a third embodiment of the present disclosure in an enlarged fashion.

FIG. 8 is a longitudinal-sectional view separately illustrating a tube and a swirler of a nozzle according to a third embodiment of the present disclosure in an enlarged fashion.

Hereinafter, a combustor nozzle 1220 according to a third embodiment of the present disclosure will be described in detail with reference to FIG. 8. Since the combustor nozzle 1220 according to the third embodiment of the present disclosure is the same as the combustor nozzle 1220 according to the first embodiment of the present disclosure, except for a third fuel port 1523, a redundant description thereof will be omitted.

In the combustor nozzle 1220 according to the third embodiment, the fuel port includes the third fuel port 1523. Instead of or in addition to the first fuel port 1521 and the second fuel port 1522, the third fuel port 1523 may be disposed in front of the swirler 1530. In order for the third fuel port 1523 to be disposed, an area in which the third fuel port 1523 is disposed is required to be between the front end of the tube 1520 and the front of the swirler 1530, so the third embodiment of the present disclosure may be applied when the swirler 1530 is disposed so as to be spaced apart from the front end of the tube 1520.

However, even if the third fuel port 1523 is disposed, the swirler 1530 is preferably disposed closer to the front side of the tube 1520 than the rear end side of the tube 1520. That is, it is preferred that the swirler 1530 is spaced apart from the front end of the tube 1520 by a small gap, in which the third fuel port is disposed. For example, the gap may be formed to be smaller than the axial length of the swirler 1530. Accordingly, even when the third fuel port 1523 is disposed, the length of the tube 1520 can be minimized.

According to an embodiment, the third fuel port 1523 is formed to pass through the tube 1520 and communicates with the fuel flow path 1513 of the fuel plenum 1510 so that the third fuel port communicates with the interior of the tube 1520. Accordingly, the third fuel port 1523 may inject the fuel in the fuel flow path 1513 toward the front side before the swirler 1530. In this case, before air passes through the swirler 1530, the fuel may be injected into the air, so the air and the fuel may be mixed in advance in front of the swirler 1530. Accordingly, after being mixed in advance, the air and the fuel are mixed once again while passing through the swirler 1530, so the degree of mixing of the air and the fuel can be improved.

Figure 9:
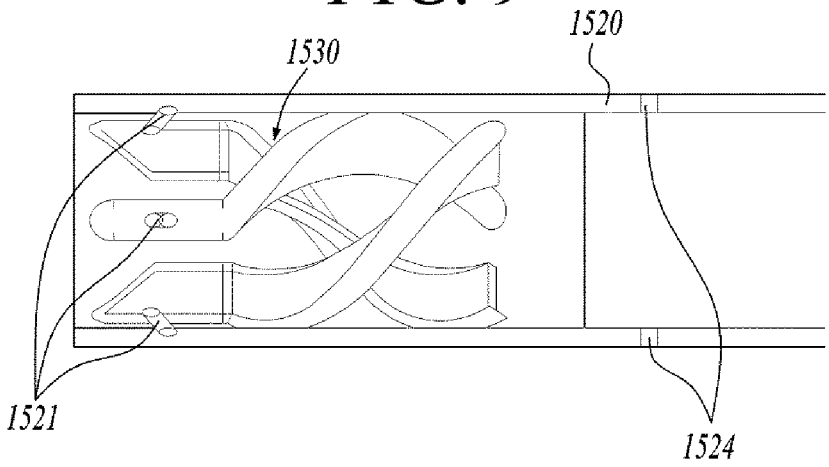
FIG. 9 is a longitudinal-sectional view separately illustrating a tube and a swirler of a nozzle according to a second embodiment of the present disclosure in an enlarged fashion.

FIG. 9 is a longitudinal-sectional view separately illustrating a tube and a swirler of a nozzle according to a fourth embodiment of the present disclosure in an enlarged fashion.

Hereinafter, a combustor nozzle 1220 according to a fourth embodiment of the present disclosure will be described in detail with reference to FIG. 9. Since the combustor nozzle 1220 according to the fourth embodiment of the present disclosure is the same as the combustor nozzle 1220 according to the first embodiment of the present disclosure, except for a fourth fuel port 1524, a redundant description thereof will be omitted.

In the combustor nozzle 1220 according to the fourth embodiment of the present disclosure, the fuel port includes the fourth fuel port 1524. Instead of or in addition to the first fuel port 1521 and the second fuel port 1522, the fourth fuel port 1524 may be disposed at the rear side of the swirler 1530. Since the fourth fuel port 1524 is disposed at the rear side of the swirler 1530, unlike the third embodiment of the present disclosure, the swirler 1530 may be disposed at the front end terminal of the tube 1520.

According to an embodiment, the fourth fuel port 1524 is preferably disposed at a position close to the swirler 1530, while still being disposed behind the swirler 1530. Otherwise, if the fourth fuel port is separated away from the swirler 1524, the mixing degree of air and fuel may deteriorate. According to an embodiment, a gap between the fourth fuel port 1524 and the swirler 1530 may be formed to be smaller than the axial length of the swirler 1530.

According to an embodiment, the fourth fuel port 1524 is formed through the tube 1520 and communicates with the fuel flow path 1513 of the fuel plenum 1510 so that the fourth fuel port communicates with the interior of the tube 1520. Accordingly, the fourth fuel port 1524 may inject fuel in the fuel flow path 1513 toward the rear side of the swirler 1530. In this case, since fuel can be additionally injected from the rear side of the swirler 1530, there is an advantage in that a ratio of fuel in the air-fuel mixture can be further increased.

While the embodiments of the present disclosure have been described, it will be apparent to those skilled in the art that various modifications and variations can be made in the present disclosure through addition, change, omission, or substitution of components without departing from the spirit of the invention as set forth in the appended claims, and such modifications and changes may also be included within the scope of the present disclosure. Also, it is noted that any one feature of an embodiment of the present disclosure described in the specification may be applied to another embodiment of the present disclosure.

The invention claimed is:

1. A combustor nozzle comprising a nozzle module, the nozzle module comprising:

a fuel supply pipe supplying fuel from the front side to the rear side;

a fuel plenum having an internal fuel flow path through which the fuel flows and communicating with the fuel supply pipe;

an air inlet formed in front of the fuel plenum;

a plurality of tubes disposed through a rear side of the fuel plenum, wherein a front end of each tube communicates with the air inlet, and a fuel port communicating with the fuel flow path is formed on a lateral side of each tube; and a swirler provided with a plurality of swirling guides disposed obliquely in axial and circumferential directions on an inner circumferential surface of each of the plurality of tubes to swirl fluid, with a central portion thereof opened when viewed from the axial direction of the tube, wherein each of the plurality of swirling guides is positioned to overlap with its adjacent swirling guide when viewed in the axial direction.

2. The combustor nozzle according to claim 1, wherein the swirler has the central portion opened in a circular shape when viewed from the axial direction of the tube.

3. The combustor nozzle according to claim 1, wherein the plurality of swirling guides are disposed in a continuous annular shape when viewed from the axial direction of the tube.

4. The combustor nozzle according to claim 1, wherein each of the plurality of swirling guides includes a straight part extending along the axial direction of the tube and a swirling part extending in the axial and circumferential directions of the tube from a rear end of the straight part.

5. The combustor nozzle according to claim 4, wherein the swirling part is formed to be inclined in a curved form on the tube.

6. The combustor nozzle according to claim 4, wherein the length of the swirling part in the axial direction of the tube is formed longer than that of the straight part.

7. The combustor nozzle according to claim 4, wherein a front end of the straight part is provided with an inclined portion inclined toward the rear side as the inclined portion extends from the outside toward the inside of the tube.

8. The combustor nozzle according to claim 1, wherein the fuel port includes a first fuel port on each of the plurality of swirling guides, with each respective fuel port passing through both the tube and its corresponding swirling guide.

9. The combustor nozzle according to claim 4, wherein the fuel port includes a first fuel port on the straight part of each of the plurality of swirling guides, with each respective fuel port passing through both the tube and its corresponding swirling guide.

10. The combustor nozzle according to claim 8, wherein the fuel port includes a second fuel port passing through the tube and disposed between the plurality of swirling guides.

11. The combustor nozzle according to claim 9, wherein the fuel port includes a second fuel port passing through the tube and disposed between the straight parts.

12. The combustor nozzle according to claim 9, wherein the fuel port includes a second fuel port passing through the tube and disposed between the plurality of swirling guides.

13. The combustor nozzle according to claim 1, wherein the swirler is disposed at the front end of the tube.

14. The combustor nozzle according to claim 1, wherein the fuel port includes a front fuel port passing through the tube and disposed at a front side of the swirler.

15. The combustor nozzle according to claim 1, wherein the fuel port includes a rear fuel port passing through the tube and disposed at a rear side of the swirler.

16. A combustor comprising a combustor nozzle comprising a nozzle module, and a duct assembly coupled to one side of the combustor nozzle and in which fuel and air are combusted, and the combustion gases are delivered to a turbine, the nozzle module comprising:

a fuel supply pipe supplying fuel from the front side to the rear side;

a fuel plenum having an internal fuel flow path through which the fuel flows and communicating with the fuel supply pipe;

an air inlet formed in front of the fuel plenum;

a plurality of tubes disposed through a rear side of the fuel plenum, wherein a front end of each tube communicates with the air inlet, and a fuel port communicating with the fuel flow path is formed on a lateral side of each tube; and a swirler provided with a plurality of swirling guides disposed obliquely in axial and circumferential directions on an inner circumferential surface of each of the plurality of tubes to swirl fluid, with a central portion thereof opened when viewed from the axial direction of the tube, wherein each of the plurality of swirling guides is positioned to overlap with its adjacent swirling guide when viewed in the axial direction.

17. The combustor according to claim 16, wherein the swirler has the central portion opened in a circular shape when viewed from the axial direction of the tube.

18. The combustor according to claim 16, wherein each of the plurality of swirling guide includes a straight part extending along the axial direction of the tube and a swirling part extending in the axial and circumferential directions of the tube from a rear end of the straight part.

19. The combustor according to claim 16, wherein the fuel port includes a first fuel port on each of the plurality of swirling guides, with each respective fuel port passing through both the tube and its corresponding swirling guide.

20. A gas turbine comprising a compressor compressing air introduced from the outside, a combustor mixing the air compressed in the compressor and fuel and combusting an air-fuel mixture, and a turbine including a plurality of turbine blades to be rotated by combustion gases combusted in the combustor, the combustor comprising a combustor nozzle comprising a nozzle module, and a duct assembly coupled to one side of the combustor nozzle and in which the fuel and the air are combusted, and the combustion gases are delivered to the turbine, the nozzle module comprising:

a fuel supply pipe supplying fuel from the front side to the rear side;

a fuel plenum having an internal fuel flow path through which the fuel flows and communicating with the fuel supply pipe;

an air inlet formed in front of the fuel plenum;

a plurality of tubes disposed through a rear side of the fuel plenum, wherein a front end of each tube communicates with the air inlet, and a fuel port communicating with the fuel flow path is formed on a lateral side of each tube; and a swirler provided with a plurality of swirling guides disposed obliquely in axial and circumferential directions on an inner circumferential surface of each of the plurality of tubes to swirl fluid, with a central portion thereof opened when viewed from the axial direction of the tube, wherein each of the plurality of swirling guides is positioned to overlap with its adjacent swirling guide when viewed in the axial direction.

* * * * *